US008365841B2

(12) United States Patent
Dimitroff

(10) Patent No.: US 8,365,841 B2
(45) Date of Patent: Feb. 5, 2013

(54) SECTIONAL BACK REAMER APPARATUS AND METHOD FOR HORIZONTAL DIRECTIONAL DRILLING

(76) Inventor: Ted R. Dimitroff, Columbia, MO (US)

( * ) Notice: Subject to any disclaimer, the term of this patent is extended or adjusted under 35 U.S.C. 154(b) by 420 days.

(21) Appl. No.: 12/396,047

(22) Filed: Mar. 2, 2009

(65) Prior Publication Data

US 2009/0250266 A1 Oct. 8, 2009

Related U.S. Application Data

(60) Provisional application No. 61/041,967, filed on Apr. 3, 2008.

(51) Int. Cl.
*E21B 7/28* (2006.01)

(52) U.S. Cl. ..... 175/53; 175/62; 175/406; 405/184

(58) Field of Classification Search ..... 175/53, 175/62, 406; 405/184, 174, 184.1, 184.3
See application file for complete search history.

(56) References Cited

U.S. PATENT DOCUMENTS

| | | | | |
|---|---|---|---|---|
| 3,482,641 | A * | 12/1969 | Atkins et al. | 175/19 |
| 3,993,147 | A * | 11/1976 | Mitchell | 175/344 |
| 5,746,278 | A | 5/1998 | Bischel et al. | |
| 5,961,252 | A | 10/1999 | Mercer et al. | |
| 6,585,062 | B2 | 7/2003 | Rozendaal et al. | |
| 6,668,946 | B2 | 12/2003 | Rankin et al. | |
| 6,926,100 | B1 * | 8/2005 | Anthony et al. | 175/62 |
| 2006/0060384 | A1 * | 3/2006 | Michael | 175/53 |

OTHER PUBLICATIONS

Straightline Brochure—15% Reamers, 8 pages, www/straightlinehdd.com.

* cited by examiner

*Primary Examiner* — David Andrews
(74) *Attorney, Agent, or Firm* — McKee, Voorhees & Sease, P.L.C.

(57) ABSTRACT

An improved back reamer for horizontal directional drilling is provided with multiple components which can be assembled and disassembled before and after the back reaming process. The reamer includes a main shaft connectable to the drill string, a reamer head removably mounted on the main shaft, and a pull tab removably attached to the main shaft. Faceted couplings between the reamer shaft and head, and between the reamer head and pull tab preclude rotation between the components.

16 Claims, 6 Drawing Sheets

SECTIONAL BACK REAMER APPARATUS AND METHOD FOR HORIZONTAL DIRECTIONAL DRILLING

CROSS-REFERENCE TO RELATED APPLICATIONS

This application claims priority under 35 U.S.C. §119(e) to provisional application Ser. No. 61/041,967 filed Apr. 3, 2008, herein incorporated by reference in its entirety.

FIELD OF THE INVENTION

The present invention generally relates to a back reamer for horizontal directional drilling, and particularly, to a multi-piece, sectional back reamer which can be quickly and easily assembled and disassembled in a safe manner by an operator.

BACKGROUND OF THE INVENTION

Utility lines for water, electricity, gas, telephone, and cable television are often run underground for reasons of safety and aesthetics. Sometimes, the underground utilities can be buried in a trench that is subsequently back filled. However, trenching can be time consuming and can cause substantial damage to existing structures or roadways. Consequently, alternative techniques such as horizontal directional drilling (HDD) are becoming increasingly more popular.

A typical horizontal directional drilling machine includes a frame on which is mounted a drive mechanism that can be slidably moved along the longitudinal axis of the frame. The drive mechanism is adapted to rotate a drill string about its longitudinal axis. The drill string comprises a series of drill pipes threaded together. Sliding movement of the drive mechanism along the frame, in concert with the rotation of the drill string, causes the drill string to be longitudinally advanced into or withdrawn from the ground.

In a typical horizontal directional drilling sequence, the horizontal directional drilling machine drills a hole into the ground at an oblique angle with respect to the ground surface. To remove cuttings and dirt during drilling, drilling fluid is pumped by a pump system through the hollow drill string, over a drill head (e.g., a cutting or boring tool) at the end of the drill string, and back up through the hole. After the drill head reaches a desired depth, the drill head is then directed along a substantially horizontal path to create a horizontal hole. Once the desired length of hole has been drilled, the drill head is then directed upwards to break through the ground surface, completing a pilot bore. Alternatively, the drill head may terminate in a trench.

The diameter of the pilot bore so constructed typically must be enlarged. To accomplish this, a reamer (sometimes called a back reamer) is attached to the drill string which is pulled back along the path of the pilot hole, thus reaming out the hole to a larger diameter. The reamer usually includes a reaming or cutting surface on which is mounted cutting teeth or other cutting or grinding elements. It is also common to attach a utility line or other conduit product to the reamer so that the product is pulled through the hole behind the reamer as the reamer enlarges the hole.

A back reamer, then, may perform several functions including: mechanically cutting, grinding and loosening the soil to enlarge the pilot hole diameter, directing drilling fluid to assist in the cutting action, mixing the loosened soil with the drilling fluid such that the resulting slurry is a consistency that will flow out of the bore when displaced by whatever product is to be pulled in, and transferring the longitudinal force required to pull the product through the hole.

The back reamer is normally constructed of heavy duty steel, and comes in many different sizes to create a bore which accommodates the utility product. The back reamer also has many different configurations according to the type of soil being drilled.

Once the pilot hole is completed, a person removes the drilling head and installs the back reamer. This manual operation is dangerous, since the person typically stands in front of or straddles over the top of the reamer in order to install the reamer on the drill string.

Communication errors are known to occur, with a resulting premature actuation of the back reamer while the installer is still preparing the reamer, thus causing serious injury, and even death, to the installer. The heavy weight of the reamer also results in back problems for the installer, both during attachment of the reamer and detachment of the reamer after the utility hole is formed. Furthermore, attachment and detachment of the reamer normally requires the use of large and heavy wrenches, which also may cause injuries if the wrenches are dropped or slipped.

Therefore, a primary objective of the present invention is the provision of an improved back reamer having components which can be quickly and easily assembled and disassembled by one person.

Another objective of the present invention is the provision of an improved back reaming method of horizontal directional drilling using a back reamer having separable components.

Another objective of the present invention is the provision of an improved back reamer having a main shaft, a reamer head, and a pull tab, each of which include faceted faces to prevent rotation relative to one another after the components are assembled.

Another objective of the present invention is the provision of a back reamer having separable components having faceted surfaces to prevent rotation of the components relative to one another.

A further objective of the present invention is an improved back reamer which can be quickly and easily mounted and dismounted from the drill pipe.

A further objective of the present invention is the provision of a method of horizontal directional drilling wherein the back reamer has components which are fixed against rotation relative to one another.

Still another objective of the present invention is an improved method of horizontal directional drilling which minimizes risk of injury to the operator, while effectively and efficiently enlarging the diameter of a pre-drilled pilot hole.

These and other objectives will become apparent from the following description of the invention.

SUMMARY OF THE INVENTION

The sectional back reamer of the present invention is intended for use in horizontal directional drilling, and comprises three components which can be assembled and disassembled quick and easily by an operator at each end of the drilling operation. The reamer includes a main shaft connectable to the drill string or pipe, a reamer or cutting head mountable on the main shaft, and a pull tab mountable to the reamer. The connections between the main shaft and the reamer cutting head, and between the cutting head and the pull tab include faceted surfaces to preclude rotation of the components relative to one another. The components are assembled sequentially by the installer in the trench or on top of the ground. The smaller size and weight of the components, as compared to the prior art one-piece back reamers, simplifies and greatly improves the safety to the operator driving the attachment and detachment of the reamer's components to and from the drill pipe.

DETAILED DESCRIPTION OF THE PREFERRED EMBODIMENT

Figure 1:
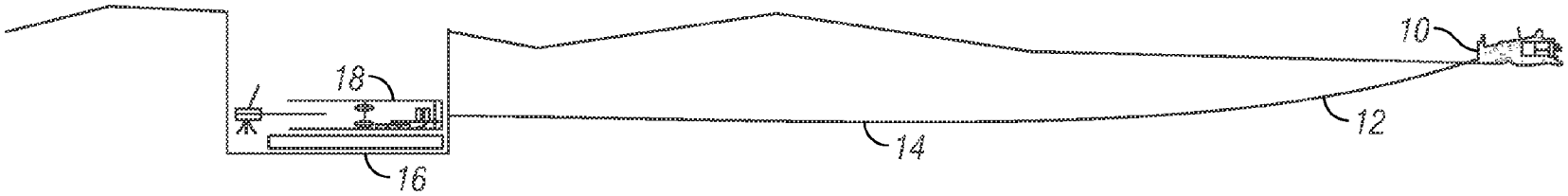
FIG. 1 (Prior Art)
FIG. 1 is a schematic view of a conventional horizontal directional drilling operation.

FIG. 1 shows a conventional horizontal directional drilling machine 10 having a drill string or pipe 12 to form a pilot hole 14 extending to a trench 16. The back reamer 18 is attached to the forward end of the drill string 12 in the trench and then pulled backwardly through the pilot hole 14 to enlarge the hole.

Figure 2:
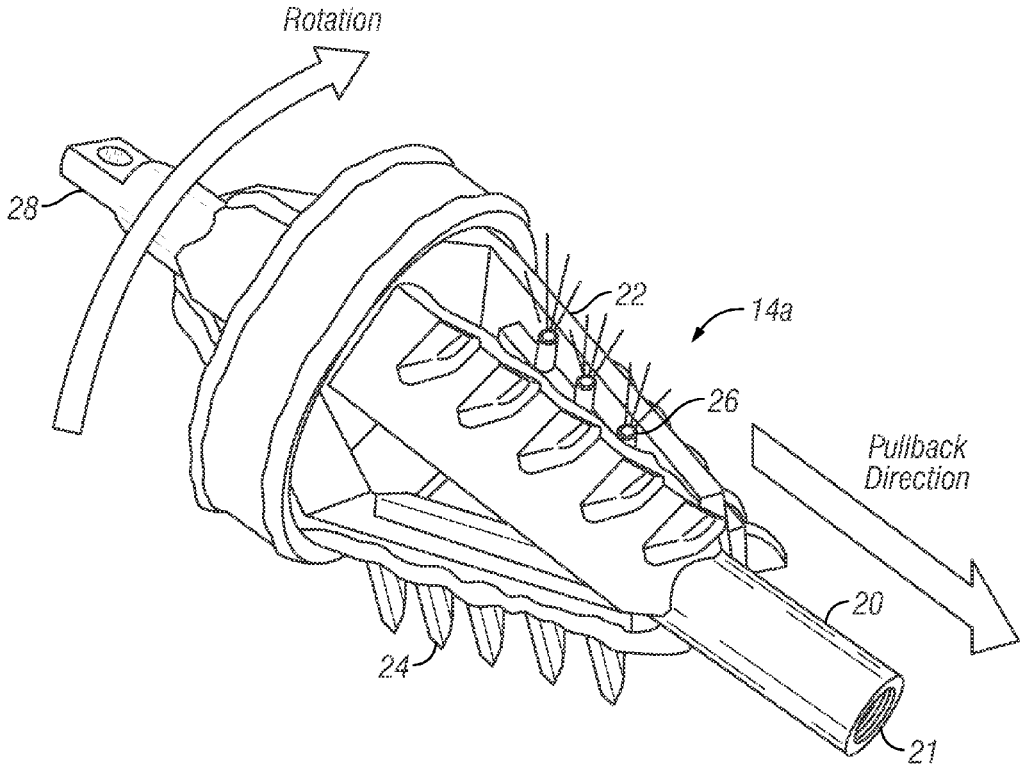
FIG. 2 (Prior Art)
FIG. 2 is a perspective view of one configuration of a prior art back reamer.
Figure 3:
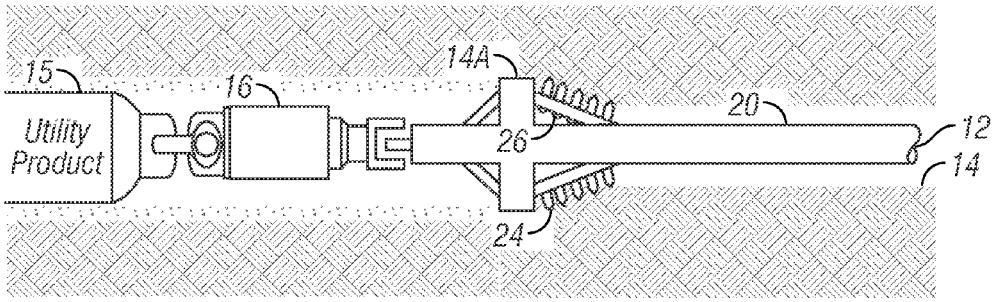
FIG.3 (Prior Art)
FIG. 3 is a schematic view of the reamer of FIG. 2 installed on the drill pipe for horizontal directional drilling.
Figure 4:
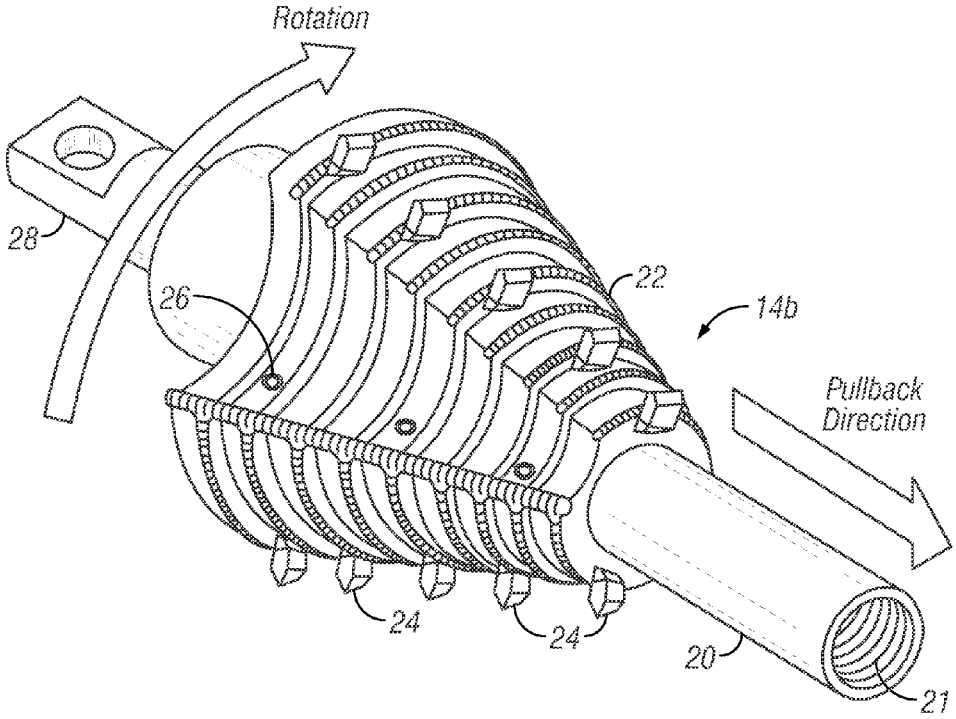
FIG. 4 (Prior Art)
FIG. 4 is a perspective view of another configuration of a conventional back reamer.
Figure 5:
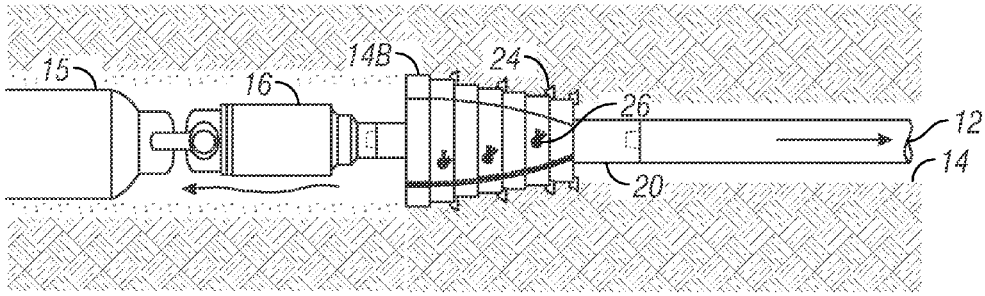
FIG. 5 (Prior Art)
FIG. 5 is a schematic view showing the back reamer of FIG. 4 installed on the drill pipe for horizontal directional drilling.

Two conventional configurations of back reamers 14A and 14B are shown in FIGS. 2 and 4. As seen in FIGS. 3 and 5, a utility product 15 is attached to the reamer 14A, 14B via a swivel coupling 16 so as to be pulled through the enlarged hole as the reamer 14A, 14B is pulled by the drilling machine 10.

Each of the conventional reamers 14A, 14B include a front pipe 20 having internal threads 21 for threadable coupling with the forward end of the drill pipe 12. The cutting head or body 22 of the reamer 14A, 14B includes cutting tools or bits 24 and fluid jets 26. The rear end of each reamer 14A, 14B includes a pulling tab 28 to which the swivel coupler 16 is attached, which in turn connects to the utility product 15, as seen in FIGS. 3 and 5.

The conventional reamers 14A, 14B are heavy duty, one piece construction with diameters up to 36 inches. The size and weight of these reamers makes their handling and installation difficult and dangerous.

The improved multi-piece, sectional reamer 30 of the present invention is shown in FIGS. 6-9 and includes a main shaft 32, a reamer head or body 34, and a pull tab 36 which can be quickly and easily assembled and disassembled to and from one another. More particularly, the main shaft 32 is hollow and includes external threads 33 on the forward end for threadable coupling to the forward end of the drill pipe 12 and an open opposite end 35. Alternatively, the reamer shaft 32 may have internal threads on the forward end for coupling to the drill pipe 12, as in the prior art.

The cutting head 34 has a hollow hub 38 which slides on to the rearward end of the main shaft 32. The head 34 includes a cylindrical shroud 41 surrounding the hub 38 and connected to the hub 38 by a plurality of spokes 43. The pull tab 36 is slidably received in the rearward end of the hub 38 and includes threads 37 for threaded coupling with the rearward end of the reamer shaft 32. Preferably, the main shaft 32, the hub 38 of the cutting head 34, and the pulling tab 36 each include one or more facets 40 for mating coupling which precludes rotation of the components relative to one another. The components of the reamer 30 can be removably secured to one another in any convenient manner, such as by a bolt 50 extending through bolt holes 42, 45 on the head 34 and tab 36, respectively. Thus, the pull tab 36 is fixed to both the main shaft 32 and to the head 34 so as to lock the three components together. The main shaft 32 and/or hub 34 also include a plurality of fluid jets 44 for ejecting fluid to carry the cut soil and material out of the drilled hole. A plurality of cutting teeth or bits 46 are welded or otherwise mounted on the shroud 41, and a plurality of teeth or cutting bits 48 are similarly attached to the spokes 43.

Figure 6:
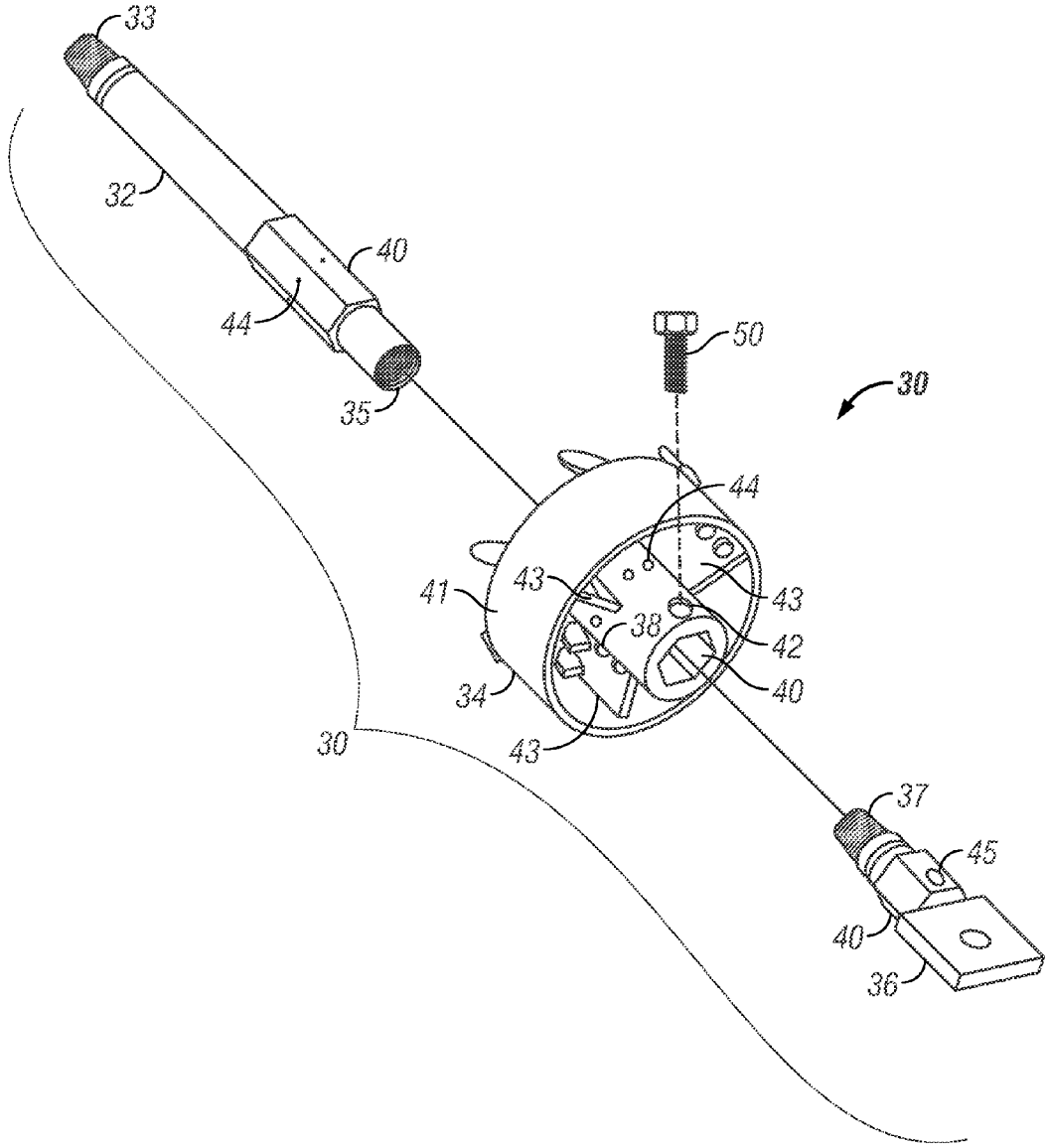
FIG. 6 is an exploded view of the sectional back reamer of the present invention.
Figure 7:
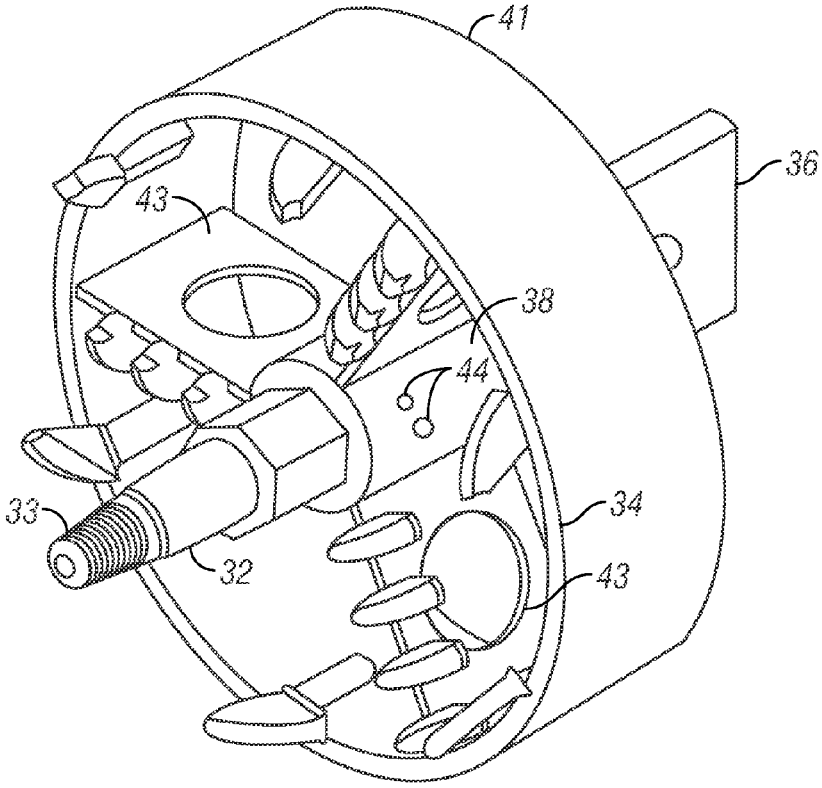
FIG. 7 is a perspective view of the assembled sectional reamer of the present invention.
Figure 8:
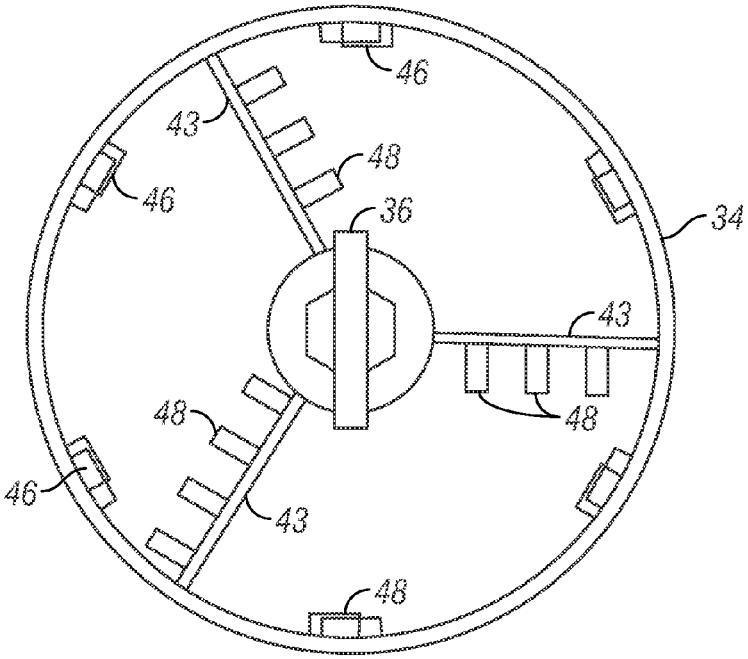
FIG. 8 is a rear end view of the assembled reamer of the present invention.
Figure 9:
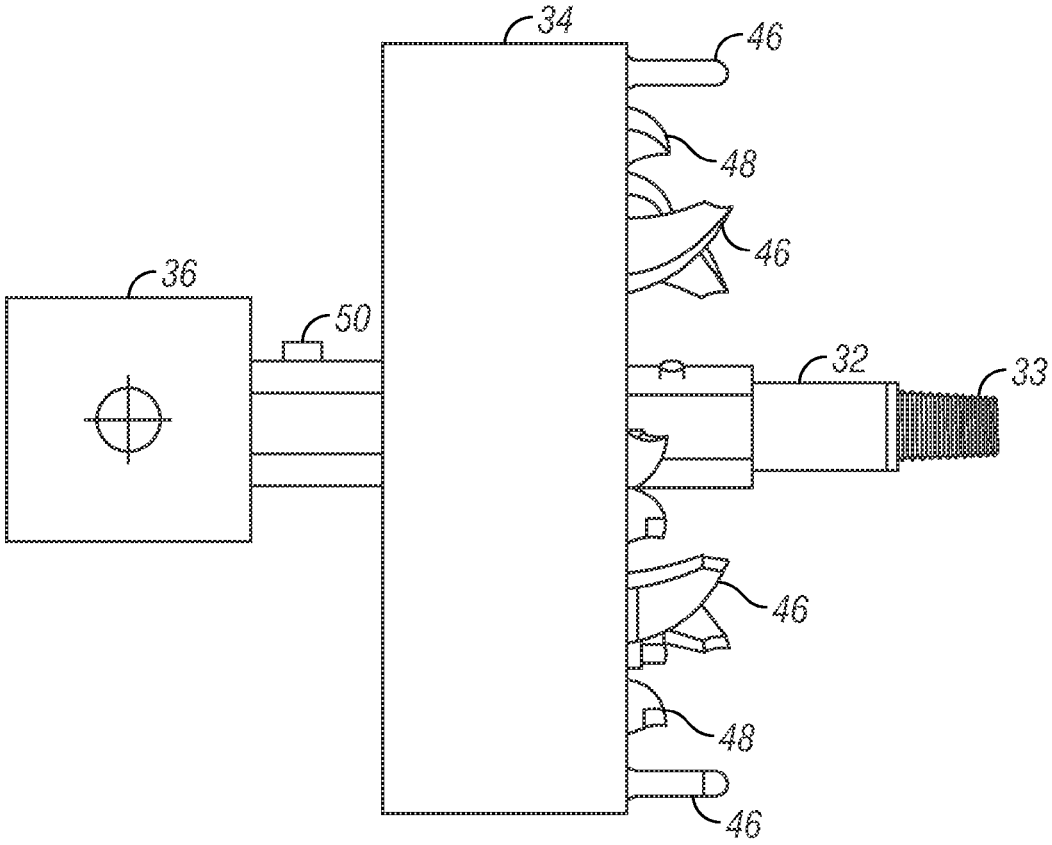
FIG. 9 is a side elevation view of the reamer of the present invention.

In use, after the pilot hole 14 is drilled, the reamer 30 is mounted to the pipe 12. More particularly, the reamer components are sequentially assembled so as to minimize the weight required to be handled by the installer at any given time. The first step in the assembly sequence is to threadably mount the reamer shaft 32 to the end of the drill pipe 12. Then, the reamer head or body 34 is slid over the end of the shaft 32. The pull tab 36 is then inserted into the open end of the head 34, and the end 37 of the tab 36 threaded onto the main shaft 32. The bolt 50 is then inserted through the hole 42 on the head 34 and threaded into the hole 45 on the pull tab 36. As seen in FIGS. 6 and 9, the faceted surfaces 40 on the shaft 32, the tabs 36, and the hub 38 are aligned for assembly of the reamer 30.

After the pilot hole 14 has been enlarged by the back reamer 30, the back reamer components 32, 34, 36 can be quickly and easily disassembled in the reverse sequence. The smaller, lighter, components of the reamer 10 allow the installer to assemble and disassemble the unit with substantially reduced risk of injury, with reduced coupling forces, and lighter weight tools. Thus, the multi-piece improved back reamer 30 of the present invention inherently improves the safety for the installer or operator, as compared to heavy duty, one-piece prior art reamers.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A back reamer for horizontal directional drilling, comprising:

a reamer shaft adapted to he connected to a drill string;

a reamer head removably mounted on the reamer shaft a pull tab removably mounted on the reamer shaft through male and female threads, which mate with one another, on the tab and on the shaft;

the reamer shaft and reamer head have mating faceted surfaces formed thereon to preclude rotation relative to one another;

the reamer head and pull tab have mating faceted surfaces formed thereon to preclude rotation relative to one another; and the faceted surfaces on the shaft and on the tab being aligned with one another for mating engagement by the faceted surface on the head.

2. The back reamer of claim 1 further comprising a plurality of fluid jets for ejecting fluid.

3. The back reamer of claim 1 wherein the reamer shaft and reamer head are slidably coupled together.

4. The back reamer of claim 1 wherein the reamer head and pull tab are bolted together.

5. The back reamer of claim 1 wherein the reamer head includes a cylindrical shroud with radially extending spokes, with the shroud and spokes having cutting members for cutting soil.

6. The improved back reamer of claim 1 wherein the reamer head has a hub with opposite ends and a faceted bore formed therein, the reamer shaft has a faceted surface formed thereon for mating with the faceted bore at one end of the hub, and the pull tab has a faceted surface formed thereon for mating with the faceted bore at an opposite end of the hub.

7. The back reamer of claim 1 wherein the male and female threads on the tab and on the shaft couple the tab and shall directly to one another without intermediate connectors.

8. A method of horizontal directional drilling, comprising:

drilling a pilot hole using a drill pipe;

attaching a reamer shaft to a forward end of the drill pipe;

then removably mounting a reamer head to the reamer shaft;

then removably attaching a pull tab directly to the reamer shaft through mating threads on the pull tab and shaft;

then attaching a utility product to the pull tab;

then pulling the drill pipe rearwardly to back ream the pilot hole to a larger diameter with the reamer head;

precluding rotation of the reamer shaft relative to the reamer head with mating faceted surfaces formed on the head and on the shaft;

precluding rotation of the reamer head relative to the pull tab with mating faceted surfaces formed on the head and on the pull tab; and aligning the faceted surfaces on the shaft and on the tab with one another for mating engagement by the faceted surface of the head.

9. The method of claim 8 wherein the reamer head and pull tab are bolted together.

10. The method of claim 8 further comprising supplying fluid through jets in the main shaft to carry soil out of the enlarged hole.

11. The method of claim 8 further comprising disassembling the pull tab, reamer head and reamer shaft by reversing the assembly sequence.

12. The method of claim 8 wherein attachment of the pull tab to the shaft is made by male and female threads which mate with one another.

13. An improved back reamer for an underground directional boring machine having a drill pipe, comprising:

a reamer shaft having a forward end mountable onto the drill pipe, and having a rearward end;

a reamer head mounted on the rear end of the reamer shaft;

a pull tab on the reamer head;

a first faceted surface formed on the head;

a second facet surface formed on the shaft;

a third faceted surface formed on the pull tab;

the first faceted surface of the head matingly engaging the second and third faceted surfaces of the shaft and of the tab to preclude rotation of the shaft and tab relative to the head and relative to one another; and the faceted surfaces on the shaft and on the tab being aligned with one another for mating engagement by the faceted surface on the head.

14. The improved back reamer of claim 13 wherein the reamer head and pull tab are fixed together.

15. The improved back reamer of claim 13 wherein the pull tab and shaft having mating male and female threads for coupling the pull tab directly to the shaft.

16. The improved back reamer of claim 13 wherein the pull tab and shaft are in direct coupled engagement with one another.

* * * * *

UNITED STATES PATENT AND TRADEMARK OFFICE

CERTIFICATE OF CORRECTION

PATENT NO. : 8,365,841 B2
APPLICATION NO. : 12/396047
DATED : February 5, 2013
INVENTOR(S) : Dimitroff It is certified that error appears in the above-identified patent and that said Letters Patent is hereby corrected as shown below:

Col. 4, Claim 1, Line 52:
DELETE after to "he"
ADD after to --be--

Col. 4, Claim 1, Line 53:
ADD after shaft --;--

Col. 5, Claim 7, Line 16:
DELETE after and "shall"
ADD after and --shaft--

Signed and Sealed this
Second Day of April, 2013

Teresa Stanek Rea
*Acting Director of the United States Patent and Trademark Office*